US005435016A

United States Patent [19]

Smith et al.

[11] Patent Number: 5,435,016

[45] Date of Patent: Jul. 25, 1995

[54] TOILET FLUSH HANDLE COVER

[76] Inventors: Gregory S. Smith, 1213 Division Apt. 190 3; Edward D. Rhead, 1316 Knoll Dr., both of Oceanside, Calif. 92054

[21] Appl. No.: 280,115

[22] Filed: Jul. 25, 1994

[51] Int. Cl.[6] ..... A47K 13/10

[52] U.S. Cl. ..... 4/234; 4/237; 4/250; 4/246.1

[58] Field of Search ..... 4/246.1, 234, 237, 250, 4/405, 411, 412, 413

[56] References Cited

U.S. PATENT DOCUMENTS

| | | | |
|---|---|---|---|
| 1,999,555 | 4/1935 | Adams | 4/246.1 |
| 2,758,315 | 8/1956 | Hylton | 4/246.1 |
| 4,195,372 | 4/1980 | Farina . | |
| 4,477,933 | 10/1984 | Leckie . | |
| 4,512,046 | 4/1985 | Riggle . | |
| 4,519,105 | 5/1985 | Blanck . | |
| 4,551,866 | 11/1985 | Hibbs . | |
| 4,839,928 | 6/1989 | Probasco . | |
| 4,920,856 | 5/1990 | Giallourakis | 4/246.1 |
| 5,056,165 | 10/1991 | Wescott, Sr. . | |

FOREIGN PATENT DOCUMENTS

| | | | |
|---|---|---|---|
| 56750 | 9/1939 | Denmark | 4/237 |
| 2256206 | 12/1992 | United Kingdom . | |

*Primary Examiner*—J. Casimer Jacyna
*Assistant Examiner*—Charles R. Eloshway
*Attorney, Agent, or Firm*—Richard C. Litman

[57] ABSTRACT

A toilet flush handle cover or guard is attachable to the bottom of a toilet seat and provides cover for the flush handle of a conventional toilet when the seat is raised to an upright position. The cover is formed to require a male user of the toilet to lower the seat to access the flush handle and flush the toilet after use, thereby providing considerate positioning of the seat of the toilet in the lowered position for subsequent female users. The flush handle cover may be formed in various configurations in order to provide proper coverage for various flush handles as desired, or alternatively may be formed as a single, integral unit with the toilet seat to extend therefrom. The present handle cover is adapted to remain clear of the upper surface of the seat and of any portion of the lid or tank, thus insuring comfort for a user of the toilet. The handle cover may be formed of a variety of materials, such as relatively thin sheet metal bent or formed to the proper shape, but is preferably formed of plastic and/or of the same materials as the accompanying toilet seat.

12 Claims, 4 Drawing Sheets

TOILET FLUSH HANDLE COVER

FIELD OF THE INVENTION

The present invention relates generally to flush toilet facilities, and more specifically to a cover installable on or integrated with the seat, which cover fits over the flush handle on the toilet tank when the seat is raised. The result is that the seat must be lowered before the handle may be used to flush the toilet.

BACKGROUND OF THE INVENTION

Since the development of the hinged toilet seat, there has been an ongoing problem between men and women who use the same toilets. The hinged seat was developed for sanitary reasons, to allow men, who naturally urinate while standing, to do so without inadvertently wetting the seat. After finishing, the tendency is to leave the seat in the upright position. Women, who always use toilets with the seat in the lowered position, have seen this as inconsiderate or worse on the part of men, and men are constantly reminded by women to return the seat to the lowered position after using a toilet. Even so, it can be difficult for a male to remember to do so under all circumstances.

The need arises for a device to force persons using a toilet to return the seat to the lowered position without fail, after using the toilet. The device should preclude the use of another function of the toilet (i.e., operation of the flush handle) while the seat is raised. By installing such a device on the seat, or forming it integrally with the seat, the seat must be lowered in order to allow access to the flush handle.

DESCRIPTION OF THE PRIOR ART

U.S. Pat. No. 4,195,372 issued to Minnie Farina on Apr. 1, 1980 discloses an Automatic Seat Return Spring For Relatively Pivoted Toilet Seat And Cover Assemblies. The device comprises a leaf spring fitted around the standard toilet seat and lid hinge pin or rod, and serves to arcuately bias the lid and seat apart from one another to automatically urge the seat to a lowered position. A person wishing to use the toilet with the seat raised, must continually hold the seat in the raised position while performing other tasks (urination, cleaning of the bowl, etc.), which is cumbersome, to say the least. While the spring may be removed as desired, the removal operation is at least equally cumbersome, as the device is intended to remain in place. The present invention allows the seat to function normally, so it may be placed in and rest in the raised position where it will remain until again being lowered manually.

U.S. Pat. No. 4,477,933 issued to Franklin J. Leckie on Oct. 23, 1984 discloses a Toilet Seat Closure comprising a coil spring securable to the lip of the water tank of a toilet, and disposed to the front thereof to apply resilient pressure to a lid which is raised against it. As the seat is installed between the lid and the rim, the result will be to automatically urge the seat downward along with the lid. Again, the seat (and lid) must be continually held in the upright or raised position when the toilet is used by standing males or for cleaning, which operation is cumbersome. As in the Farina device discussed above, the Leckie spring may be removed by lifting the toilet tank cover and removing the spring from the upper edge of the tank, but that operation is also cumbersome whenever lifting of the lid and seat are desired.

U.S. Pat. No. 4,512,046 issued to Rita C. Riggle on Apr. 23, 1985 discloses a Toilet Guard adapted to be secured to a toilet lid, and at least partially covering the flush handle when the lid is raised. The device is intended to ensure that both the underlying seat and the lid are closed before the toilet may be flushed, in order to prevent access to the toilet bowl by small children. The present invention is not intended to relate to operation of the lid or to secure thereto, but rather to operation of the seat, and is adapted to secure thereto or to be formed as a unit therewith. As the seat is normally spaced somewhat away from the front surface of the toilet tank and the handle extending therefrom when the seat is raised, due to the presence of the lid between the seat and tank, the present invention in at least some embodiments allows for this spacing by means of an offset. Such is not disclosed by Riggle, as Riggle does not foresee the installation of her device on other but the lid, which is immediately adjacent the flush handle when the seat is raised.

U.S. Pat. No. 4,519,105 issued to James R. Blanck on May 28, 1985 discloses an Apparatus For Closing Toilet Seat Cover comprising a spring mounted arm having one end secured to the front surface of the toilet tank. The arm has a handle guard on the opposite end, and is normally in an outwardly disposed position from the handle. However, when the seat is raised against the arm, the arm is pushed back to cover the flush handle with the cover. When the cover is pulled forward to access the flush handle, the arm applies pressure to the top of the lid, causing it to fall forward to a closed position. The device does not secure to the seat and does not permit the seat to be lowered while the lid remains raised as in the present invention.

U.S. Pat. No. 4,551,866 issued to Walter G. Hibbs on Nov. 12, 1985 discloses an Automatic Toilet Seat Lowering Apparatus essentially comprising a spring loaded hydraulic damper secured to the back of the bowl rim and having a linkage communicating with the rear edge of the seat adjacent the hinge. When the seat is raised, the damper spring is compressed, whereupon the viscous damper fluid resists seat closure motion through the linkage and the seat is automatically lowered slowly due to gravity. No flush handle cover, or securing of a single component fixed device directly to a toilet seat, is disclosed.

U.S. Pat. No. 4,839,928 issued to Timothy C. Probasco on Jun. 20, 1989 discloses a Device For Lowering Toilet Seats comprising a device attachable to the flush handle and having a wedge extending therefrom. When the handle is pivotally operated, the wedge is driven between the lid and seat, urging the seat forward whereupon it will fall to a lowered position against the rim of the toilet bowl. The present device does not secure to the handle, but merely guards the handle against activation until the seat is lowered.

U.S. Pat. No. 5,056,165 issued to Reginald E. Wescott, Sr. on Oct. 15, 1991 discloses a Commode Flush And Seat Lift Apparatus providing for the lifting of a toilet seat upon actuation of the flushing mechanism by pedal means. The relatively complex mechanical linkage, lack of a guard or cover over the flush handle, and means raising the seat upon flush activation, rather than lowering the seat as is the intent of the present invention, render the Wescott, Sr. device completely different from the present invention.

Finally, British Patent No. 2,256,206 to Gary D. Denham et al. and published on Dec. 2, 1992 discloses a Lavatory Seat Cover having a latch extending from the forward edge thereof, with a catch normally gripping the underlying toilet seat. When the lid or cover is raised normally, the seat is also raised due to the catch raising the seat with the lid. The latch must be pulled outward from its spring biased position to release the catch and allow the lid to be raised while keeping the seat in a lowered position. The device has no relation to the toilet flush handle, and operation of the flush handle is completely independent of any action of the toilet seat or to the lowering thereof before flushing.

In addition to the above comments, it is noted that several of the above devices (Leckie, Riggle, Blanck) include either a protrusion extending from the back of the toilet tank (Leckie, Blanck) or from the back of the lid (Riggle). Many persons wish to rest their backs against the seat while using the toilet, or to lean against the tank while sitting upon the lid during other bathroom activities. The above devices preclude such postures due to their extending from the tank or back of the lid, unlike the present invention. The present invention is advantageous as in at least one embodiment it is secured to the underside of the seat, which area is not rested against at any time. In at least one other embodiment the present flush handle cover is formed as a unit with the seat and extends to one (or both) side(s) thereof, where it produces no discomfort at any time to a user of the toilet.

None of the above noted patents, taken either singly or in combination, are seen to disclose the specific arrangement of concepts disclosed by the present invention.

SUMMARY OF THE INVENTION

By the present invention, an improved guard or cover for a toilet flush handle is disclosed.

Accordingly, one of the objects of the present invention is to provide an improved toilet flush handle guard which in at least one embodiment is adapted to be secured to the underside of a toilet seat, to fit within the gap between the seat and the rim of the bowl, and to cover the flush handle of the toilet when the seat is raised, thereby requiring the seat to be lowered before the flush handle may be activated.

Another of the objects of the present invention is to provide an improved toilet flush handle guard which in at least one embodiment includes an offset providing for immediately adjacent positioning of the handle cover portion over the handle, allowing for the thickness of the seat and lid.

Yet another of the objects of the present invention is to provide an improved toilet flush handle guard which in at least one embodiment includes at least an upper and/or side handle cover extension, thereby more effectively blocking access to the flush handle before the seat is lowered.

Still another of the objects of the present invention is to provide an improved toilet flush handle guard which in at least one embodiment, may be formed in combination with a toilet seat as a single unit.

A final object of the present invention is to provide an improved toilet flush handle guard for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
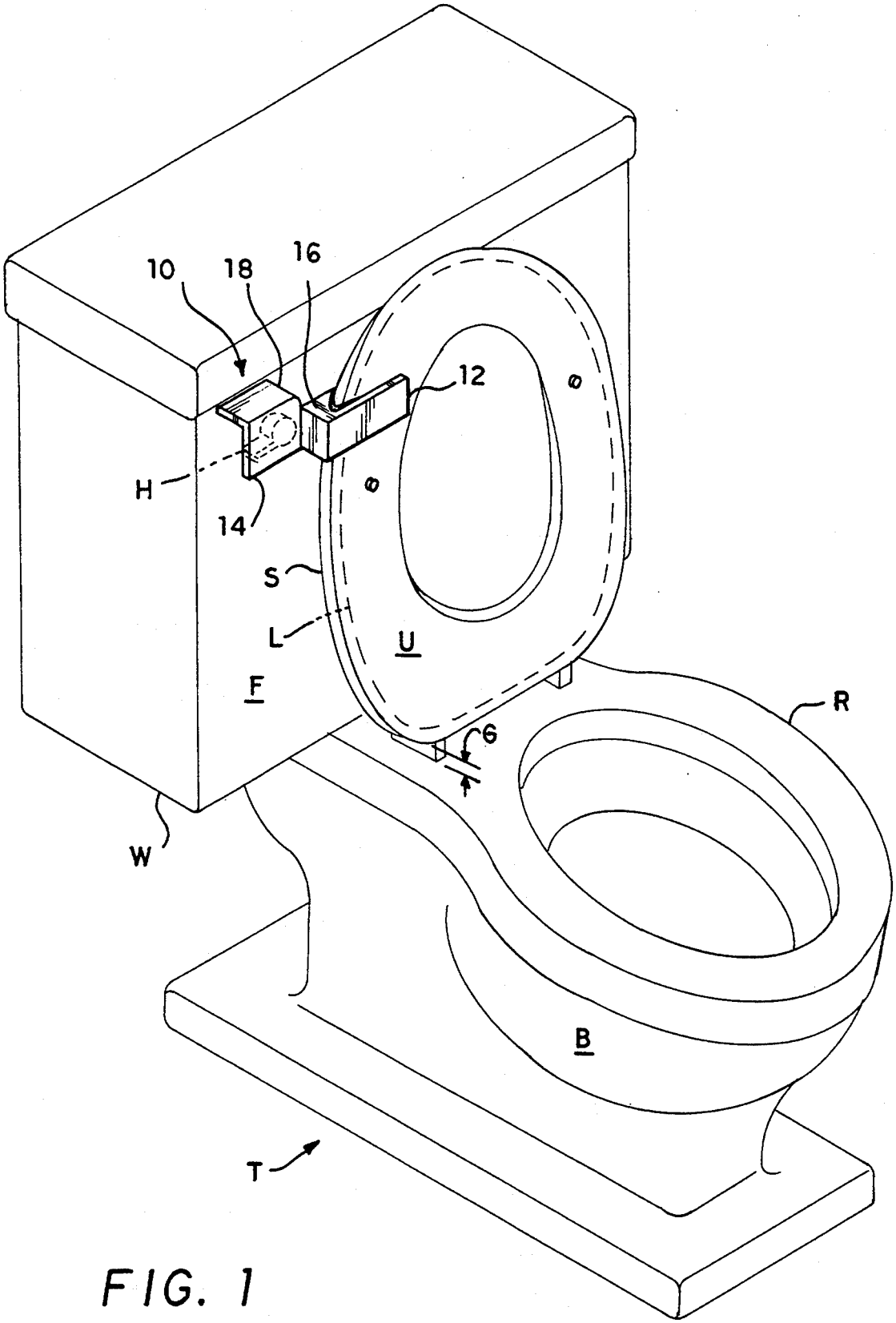
FIG. 1 is a perspective view of a conventional toilet, seat, and lid assembly having a toilet tank with flush handle extending from the upper front surface thereof, showing the flush handle cover of the present invention covering the flush handle with the seat in the raised position.

Referring now particularly to FIG. 1 of the drawings, the present invention will be seen to relate to a handle cover 10 for the flush handle H of a conventional flush toilet T, with the toilet T having a bowl B with an upper rim R therearound, and a hinged seat S and lid L each capable of being selectively lowered over the rim R or raised to rest against the front surface F of a water tank W. The handle cover 10 includes a seat attachment portion 12 and an opposite handle cover portion 14 extending therefrom, with the seat attachment portion 12 comprising a flat, planar element sufficiently thin to fit within the standard gap G provided between the underside U of the seat S and the rim R when the seat S is lowered to rest upon the rim R.

Figure 2B:
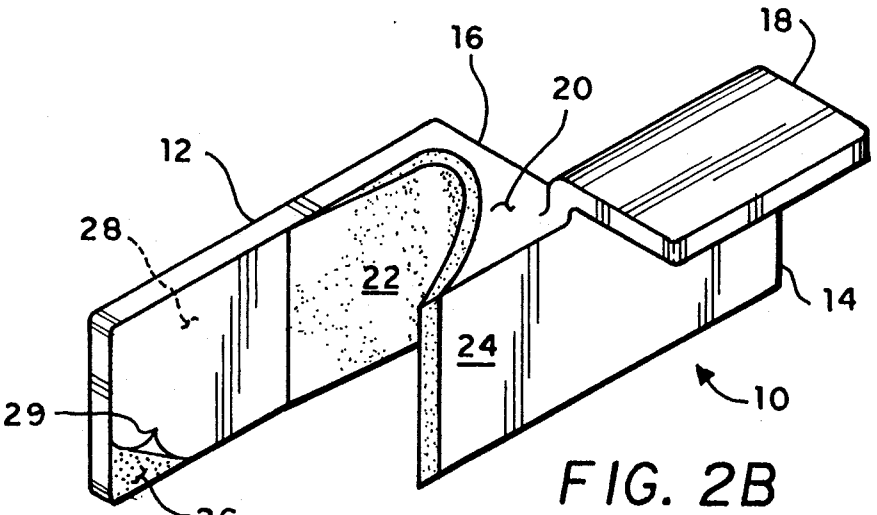
FIG. 2B is a top or rear perspective view of the embodiment of FIG. 2A, showing additional features and the adhesive seat attachment means.
Figure 2A:
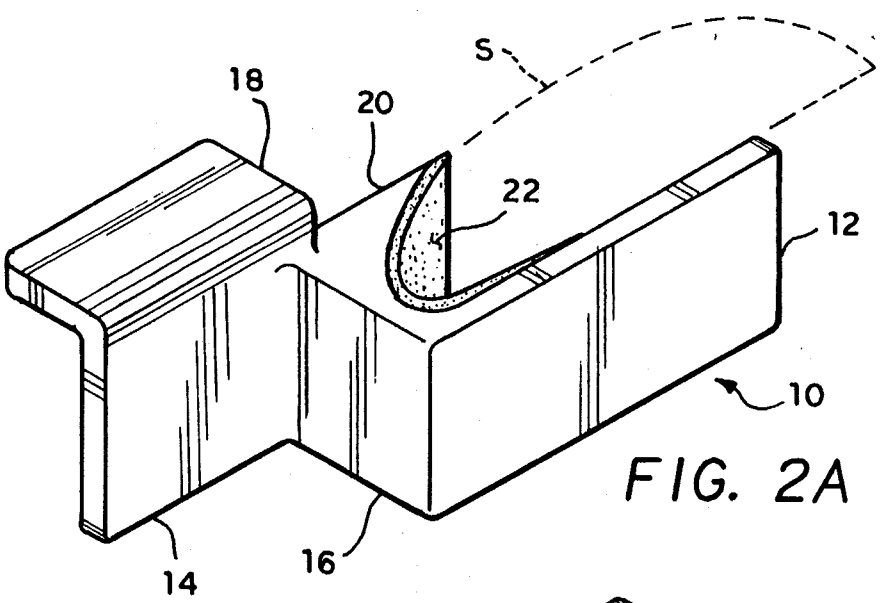
FIG. 2A is a front or bottom perspective view of one embodiment of the flush handle cover of the present invention, showing its features.

FIGS. 2A and 2B provide more detailed views of the toilet flush handle cover 10 of FIG. 1. FIG. 2A discloses a larger front perspective view (or what might be considered a bottom perspective view, when the cover 10 is secured to a lowered toilet seat S) of the handle cover 10, while FIG. 2B discloses a rear (or top, if secured to a lowered seat S) perspective view. The seat attachment portion 12 and handle cover portion 14 may include an intermediate offset portion 16, which provides for the closer placement of the cover portion to the flush handle H when the seat S is raised. As the seat S and the overlying lid L have some finite thickness, generally on the order of 1.5 to 2 inches total, a device secured to the underside U of the seat S will be spaced accordingly from the front surface F of the toilet tank W when the seat S is raised against the tank W, with the lid L being sandwiched therebetween, as shown in FIG. 1. The result is that a flat, planar component extending straight out from the underside U of the seat S with no offset will be positioned some distance from the handle H, even if it is otherwise secured to the seat to overlie the front of the handle H when the seat S is raised. The offset 16 of the flush handle cover 10 of FIGS. 1 through 2B allows the handle cover portion 14 to be positioned immediately adjacent the handle H when the seat S is raised by compensating for the combined thicknesses of the seat S and lid L; this is generally shown in FIG. 1. With the handle cover portion 14 positioned immediately adjacent to and in front of the handle H when the seat S is raised, the handle H is less accessible, thereby requiring the seat S to be moved forward and downward to a lowered position to access the handle.

Further coverage for a flush handle H may be provided with a first extension 18, which first extension 18 extends rearwardly from the upper edge of the handle cover portion 14 of the handle cover 10 when the seat S is in an upright position as shown in FIG. 1. The first extension 18 overlies the top of the handle H when the seat S is raised, thereby further preventing access of the handle H when the seat S is raised.

As noted above, the handle cover 10 secures to the underside U of a toilet seat S. Further security for the cover 10 may be provided by a fairing 20, which fits partially around and over the generally curved periphery of the seat S. The extension lip of the fairing 20 will be seen to provide further security for the handle cover 10 when it is secured to a seat S. A resilient elastomer or other lining 22 may be provided within the fairing 20, to substantially seal any gap between the fairing 20 and the seat S and provide a substantially smooth, even, and continuous surface across the seat S and the contiguous surface 24 of the fairing 20.

Handle cover 10 may be adhesively secured to the underside U of a toilet seat S my means of an adhesive coating 26 on the attachment surface 28 of the seat attachment portion 12. A removable protective overlay 29 is placed over the adhesive coating 28 before installation of the handle cover 10, and removed to expose the adhesive coating 26 to provide for the adhesive attachment of the handle cover 10 to the underside U of the toilet seat S. Other means (e.g., mechanical/screws, etc.) may be used to secure the handle cover 10 to the underside U of the seat S, as desired. However, the adhesive means provides fewer gaps, spaces, etc. due to the elimination of screw heads and the like, thereby providing for ease of cleanup of the area.

Figure 3:
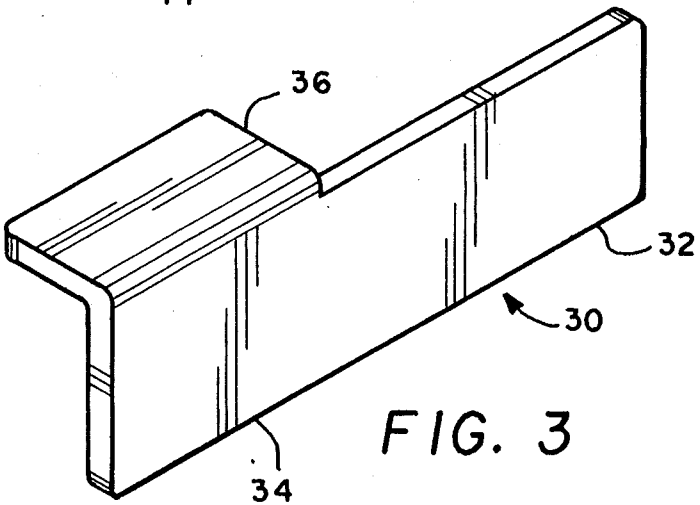
FIG. 3 is a front or bottom perspective view of another embodiment of the present flush handle cover.

FIG. 3 discloses another embodiment of the present invention, showing a somewhat simplified handle cover 30. The handle cover 30 of FIG. 3 includes a flat, planar seat attachment portion 32, with a similarly flat and planar handle cover portion 34 extending therefrom. The two portions 32 and 34 are mutually coplanar, with no offset provided. In some cases, such a relatively flat and planar handle cover 30 may provide sufficient guarding and/or coverage for some toilet flush handles, depending upon the specific configuration of the toilet and its components. A first extension 36, analogous to the first extension 18 of the handle cover 10 of FIGS. 1 through 2B, is provided to extend over a toilet flush handle H when the seat S to which the handle 30 is secured is in a raised, upright position, thereby further reducing access to a flush handle H positioned behind the handle cover 30. Handle cover 30 may be adhesively secured to the underside U or bottom of a toilet seat S, in the manner discussed above for handle cover 10, or otherwise secured to the underside U of the seat S.

Figure 4:
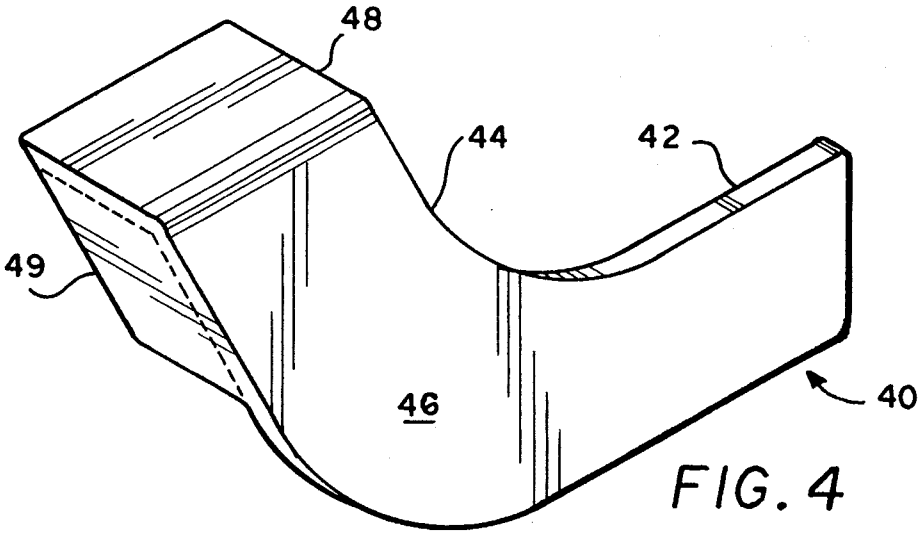
FIG. 4 is a front or bottom perspective view of yet another embodiment of the present flush handle cover.

FIG. 4 discloses yet another embodiment of the present invention, comprising a toilet flush handle cover 40. The handle cover 40 of FIG. 4 is similar to the cover 30 of FIG. 3, but includes a curved intermediate portion 46 between the seat attachment portion 42 and the handle cover portion 44. This curved intermediate portion 46 may provide for the more accurate positioning of the handle cover portion 44 over a flush handle H, depending upon the specific seat configuration, handle location, and relationship therebetween for a given toilet T. The handle cover 40 includes a first extension 48 which extends rearwardly from the handle cover portion 44 to overlie a handle H positioned thereunder when the seat S to which the handle cover 40 is attached is raised to an upright position, in the manner of the analogous first extensions of the handle covers 10 and 30 discussed above. However, the handle cover 40 of FIG. 4 also includes a second or side extension 49, which serves to block access to the handle H from the side and essentially provides a box-like enclosure from the front, top, and outboard sides of the flush handle H therein. The lower or underside and inboard side of the handle H are not directly covered by the handle cover extensions 48 and 49, but access from those directions is relatively cumbersome, thus encouraging a person to lower the seat S in order to manipulate the handle H. It will be seen that the second or side extension 49 of the handle cover 40 of FIG. 4 may also be incorporated in any of the other embodiments discussed above, as well as such features as the intermediate curved portion 46. Conversely, the offset 16 of the handle cover 10 of FIGS. 1 through 2B may be incorporated with the handle cover 40 of FIG. 4, if desired.

Figure 5:
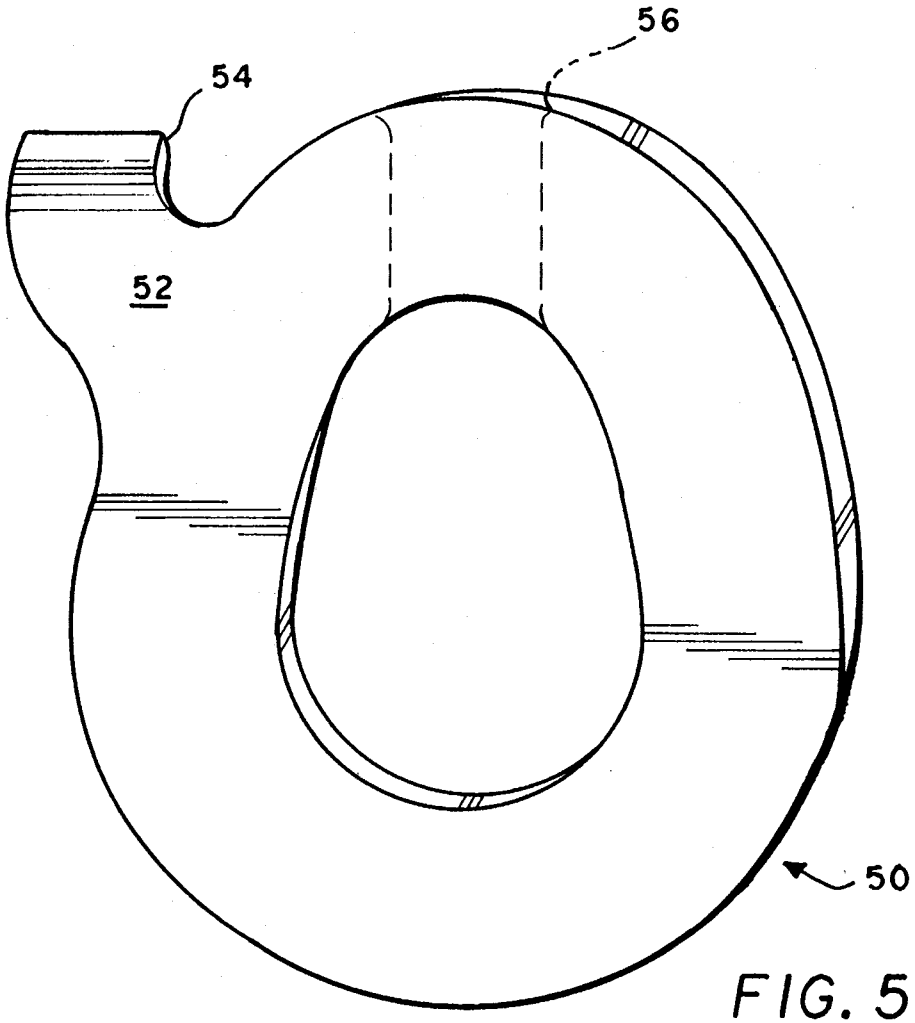
FIG. 5 is a bottom perspective view of a toilet seat having a flush handle cover formed intearally therewith.

Each of the above described embodiments of FIGS. 1 through 4 is initially provided separately from the toilet seat S, for attachment thereto to provide the benefits of the present invention. However, further embodiments, in which such flush handle covers are formed integrally with a seat, may also be provided. FIG. 5 discloses a front/bottom perspective view of a toilet seat 50 having a flush handle cover 52 formed integrally therewith and extending therefrom. The flush handle cover 52 of the seat 50 is positioned to overlie a flush handle H extending from the front surface F of a toilet water tank W when the seat 50 is raised to the upright position, thereby blocking access to the handle H until the seat 50 is lowered to expose the handle H. The handle cover 52 may also include a first extension 54 extending therefrom, in the manner of the first extensions of the embodiments of FIGS. 1 through 4 and serving a similar function. It will be seen that the seat 50 may comprise a continuous, toroidally shaped periphery, or alternatively may have an opening 56 at the front thereof (shown in broken lines); the handle cover 52 may be formed equally well with either type of seat, as desired.

Figure 6:
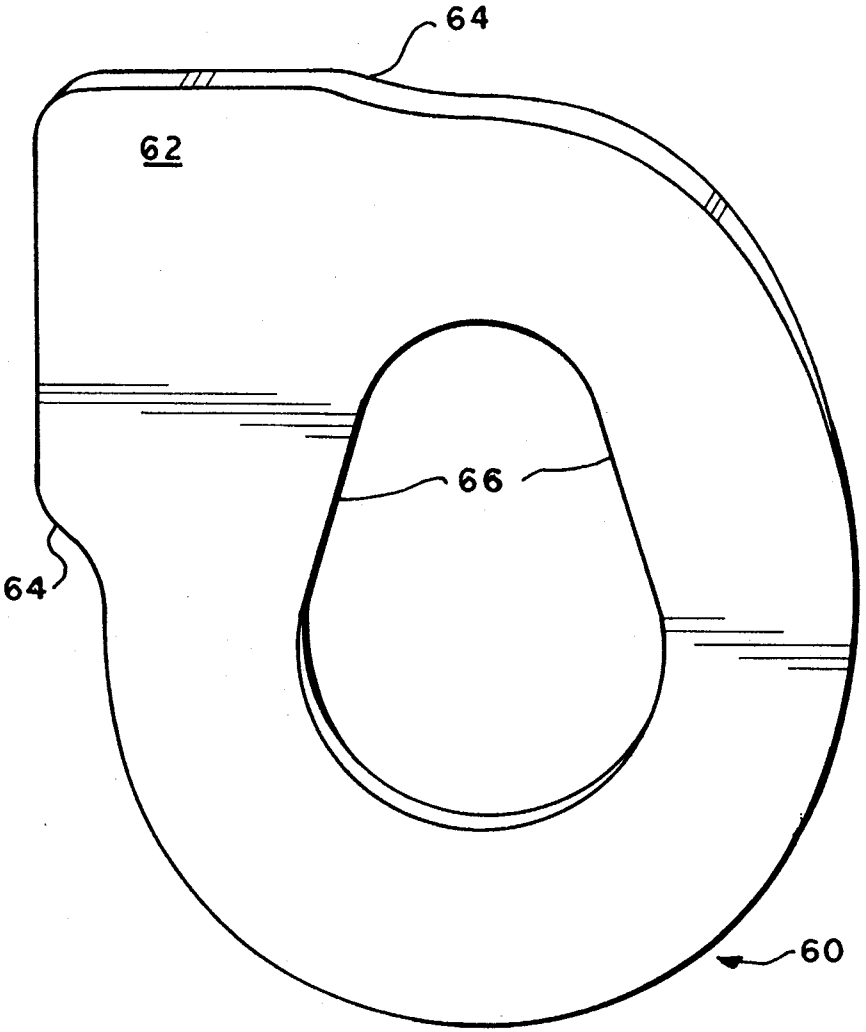
FIG. 6 is a bottom perspective view of another embodiment of an integral seat and flush handle cover.

A similar embodiment to the one of FIG. 5 is shown in FIG. 6, with a toilet seat 60 having a relatively wide handle cover 62 extending therefrom. In some cases, it may be desirable to provide a relatively large extension flange, for toilet seats 60 exposed to hard use. (e.g., public toilets and/or toilets used by small children, etc.) The relatively wide flanges 64 between the seat portion 66 and the handle cover portion 62 provide greater strength for the handle cover portion 62, and additional coverage for relatively non-standard flush handle positions. Such seats 60 may include a front opening, as in the seat 50 of FIG. 5, if desired.

Figure 8:
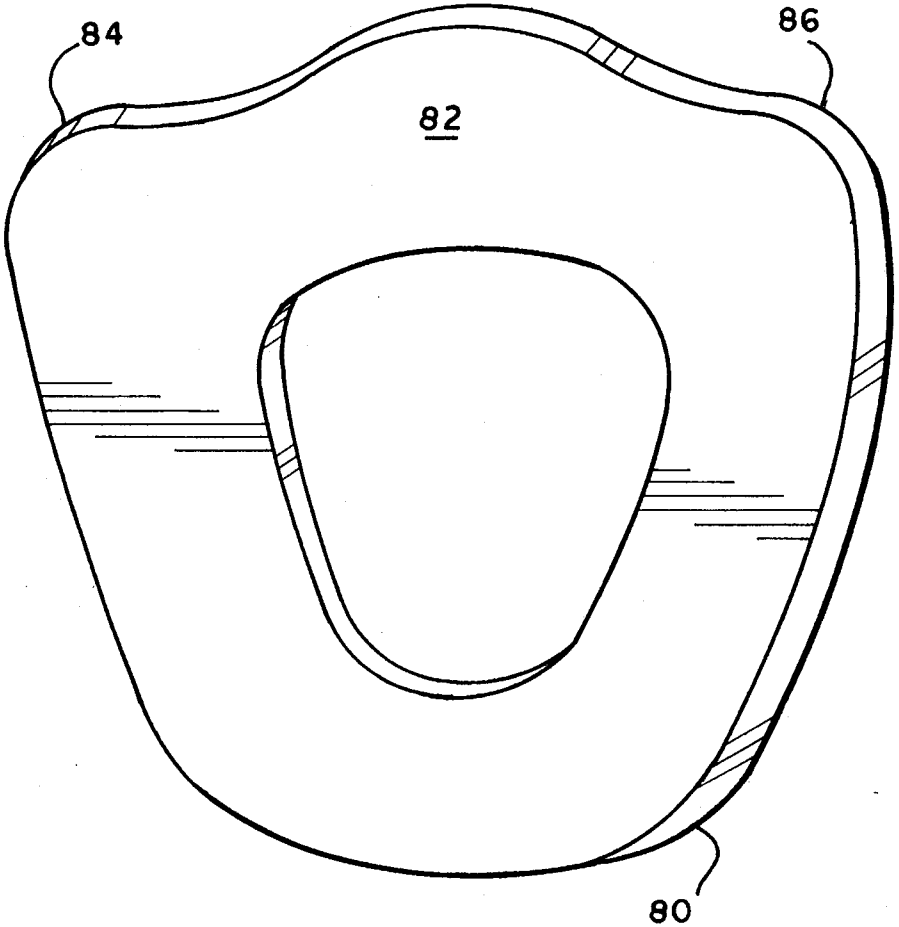
FIG. 8 is a bottom perspective view of still another embodiment, similar to that of FIG. 7.
Figure 7:
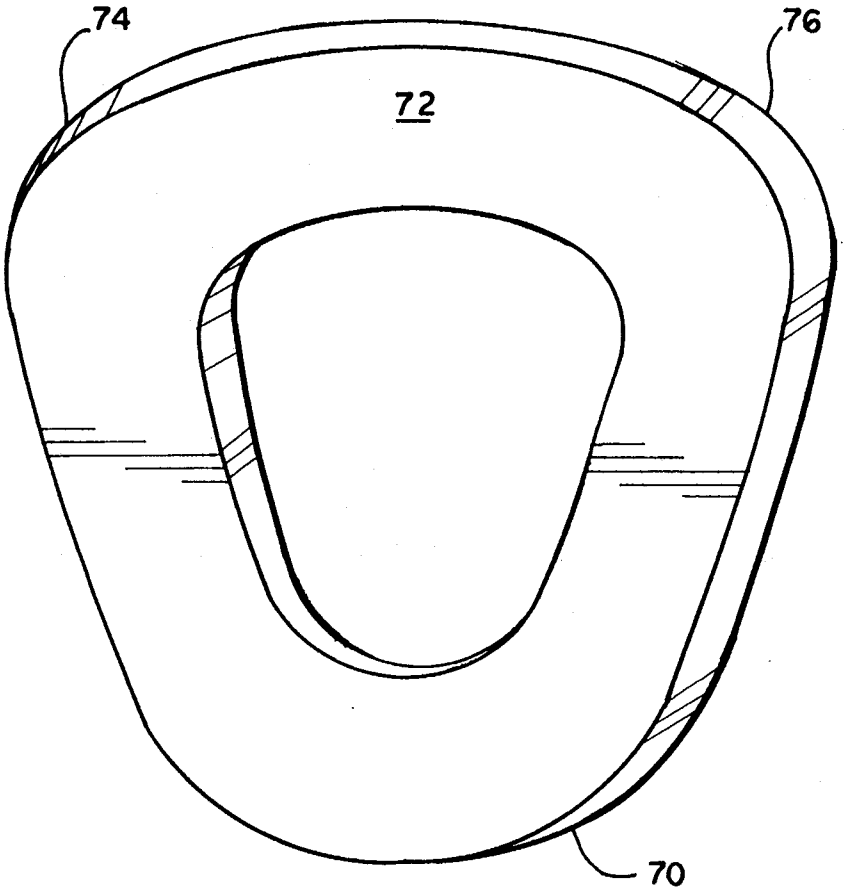
FIG. 7 is a bottom perspective view of yet another embodiment of an integral seat and flush handle cover, showing handle cover extensions symmetrically disposed to both sides.

FIGS. 7 and 8 also include unitary extensions monolithically formed as an integral component of their respective seats. In FIG. 7, front/bottom perspective view of a seat 70 is disclosed, which includes a relatively wide front portion 72 having symmetrical extensions 74 and 76 extending to each side thereof. The leftmost extension 74 serves to cover a flush handle H positioned conventionally to the left front of a typical toilet water tank W, while the right hand extension 76 provides symmetry and an additional means of lifting the seat 70 with either hand.

The seat 80 of FIG. 8 is also shown from a front and bottom perspective view, with the front portion 82 thereof also having a left side 84 and right side 86 extension to each side thereof, generally in the manner of the seat 70 of FIG. 7. It will be noted that the seat 80 of FIG. 8 has a somewhat more conventionally shaped front portion 82, with curvilinear extensions 84 and 86. The extensions 84 and 86 (or 74 and 76) may be formed as desired or required for virtually any toilet and flush handle configuration; the right side extension 86 of the seat 80 of FIG. 8 serves the same purpose as that of the right hand extension 76 of the seat 70 of FIG. 7.

The above embodiments of a toilet flush handle cover provide for the covering of a toilet flush handle H when the toilet seat S (or 50 or 60) is raised to an upright position, in order to require the seat to be lowered for a person to access the flush handle H of the toilet T. The requirement for a person to lower the seat before flushing the toilet, ensures that a subsequent (particularly female) user of the toilet will find the seat considerately lowered for their use. The various features of the above embodiments may be combined in various ways, i.e., the second or side extension 49 disclosed in FIG. 4 may be applied to the embodiments of FIGS. 1 through 3, 5, and 6, if desired. The various cover embodiments discussed above may be formed of a durable plastic material, or even stamped or otherwise formed of metal, particularly in those embodiments lending themselves to construction from a planar sheet of material. Other materials may be used as desired, depending upon the configuration of the handle cover and of the seat to which the cover is to be secured or formed integrally therewith. Accordingly, the above disclosed toilet flush handle cover in its various embodiments provides a relatively inexpensive and durable means if insuring that users of a toilet will place the seat in the lowered position after use without fail, in consideration of subsequent, particularly female, users of the toilet facility.

It is to be understood that the present invention is not limited to the sole embodiments described above, but encompasses any and all embodiments within the scope of the following claims.

I claim:

1. A toilet flush handle cover providing for coverage of the flush handle of a conventional flush toilet having a bowl with a rim, a seat having a thickness, and a lid, with the bowl rim and the seat having a gap therebetween when the seat is lowered, a tank and a flush handle extending from an upper front surface of the tank, said handle cover comprising:

a planar seat attachment portion adapted to be secured to an underside of the toilet seat and to fit within the gap between the lowered seat and the rim;

a flush handle cover portion extending from said seat attachment portion and adapted to substantially cover the flush handle of the toilet when the seat is raised to an upright position;

a fairing extending from said flush handle cover portion and adjacent to said seat attachment portion, said fairing having a contiguous surface and being adapted to fit closely around an outer periphery of an upper surface of the toilet seat, wherein said fairing provides a substantially smooth, even and continuous surface from the upper surface of the toilet seat across said contiguous surface, whereby;

actuation of the flush handle of the toilet is precluded by said flush handle cover being positioned in front of and adjacent to the flush handle when the seat to which said handle cover is attached is raised to an upright position, thereby requiring the seat to be lowered to provide access to the flush handle for operation thereof.

2. The toilet flush handle cover of claim 1 wherein:

said handle cover portion includes at least a first extension therefrom, with said first extension being rearwardly disposed above the flush handle when said handle cover is positioned in front of the toilet flush handle to thereby cover and conceal the flush handle from above when the toilet seat is raised to an upright position.

3. The toilet flush handle cover of claim 1 wherein:

said handle cover portion includes a side extension therefrom, with said extension being rearwardly disposed when said handle cover is positioned in front of the toilet flush handle to thereby cover and conceal the flush handle from the side when the toilet seat is raised to an upright position.

4. The toilet flush handle cover of claim 1 wherein:

said handle cover includes a medial portion disposed between said seat attachment portion and said handle cover portion, with said medial portion including an offset therein providing for the rearward displacement of said handle cover portion relative to said seat attachment portion when the seat is raised to an upright position, whereby;

said offset compensates for the thickness of the seat and the lid when the seat and lid are raised to an upright position and are adjacent the upper front surface of the tank, and said handle cover portion is positioned immediately adjacent the flush handle when the seat is raised to an upright position.

5. The toilet flush handle cover of claim 1 wherein:

said fairing includes a resilient seal therein, with said seal adapted to be positioned in direct contact with the outer periphery of the upper surface of the seat to provide for the positive sealing of said flush handle cover to the seat when said flush handle cover is installed thereon.

6. The toilet flush handle cover of claim 1 wherein:

said seat attachment portion includes adhesive means for the attachment thereof to an underside of the toilet seat.

7. The toilet flush handle cover of claim 6 wherein:

said seat attachment portion includes a seat attachment surface and said adhesive means comprises an adhesive coating on said seat attachment surface with a removable protective overlay thereon, whereby:

said removable protective overlay is removed and said seat attachment portion of said handle cover is adhesively secured to the underside of the toilet seat so that said handle cover portion is positioned immediately in front of and adjacent to the flush handle of the toilet when the seat is raised to an upright position.

8. The toilet flush handle cover of claim 1 wherein: said handle cover is formed of plastic material.

9. The toilet flush handle cover of claim 1 wherein: said handle cover is formed of metal.

10. A toilet flush handle cover providing for coverage of the flush handle of a conventional flush toilet having a bowl with a rim, a seat, and a lid, with the bowl rim and the seat having a gap therebetween when the seat is lowered, a tank and a flush handle extending from an upper front surface of the tank, said handle cover comprising:

a planar seat attachment portion adapted to be secured to an underside of the toilet seat and to fit within the gap between the lowered seat and the rim;

said seat attachment portion including adhesive means thereon;

a flush handle cover portion extending from said seat attachment portion and adapted to substantially cover the flush handle of the toilet when the seat is raised to an upright position;

said handle cover portion including at least a first extension and a side extension therefrom, with said first extension and said side extension each being rearwardly disposed respectively above and to a side of the flush handle when said handle cover portion is positioned in front of the toilet flush handle to provide cover and concealment for the flush handle respectively from above and side when the toilet seat is raised to an upright position;

a medial portion extending between said seat attachment portion and said handle cover portion, with said medial portion including an offset therein providing for the rearward displacement of said handle cover portion relative to said seat attachment portion when the seat is raised to an upright position;

a fairing extending from said flush handle cover portion and adjacent to said seat attachment portion, said fairing having a contiguous surface and being adapted to fit closely around an outer periphery of an upper surface of the toilet seat, wherein said fairing provides a substantially smooth, even and continuous surface from the upper surface of the toilet seat across said contiguous surface, whereby;

actuation of the flush handle of the toilet is precluded by said flush handle cover being positioned in front of and adjacent to the flush handle when the seat to which said handle cover is attached is raised to an upright position, thereby requiring the seat to be lowered to provide access to the flush handle for operation thereof.

11. The toilet flush handle cover of claim 10 wherein: said fairing includes a resilient seal therein, with said seal adapted to be positioned in direct contact with the outer periphery of the upper surface of the seat to provide for the positive sealing of said flush handle cover to the seat when said flush handle cover is installed thereon.

12. The toilet flush handle cover of claim 10 wherein: said handle cover is formed of plastic material.

* * * * *